US010048649B2

(12) United States Patent
Charbon et al.

(10) Patent No.: US 10,048,649 B2
(45) Date of Patent: Aug. 14, 2018

(54) TIMEPIECE SPRING MADE OF AUSTENITIC STAINLESS STEEL

(71) Applicant: Nivarox-FAR S.A., Le Locle (CH)

(72) Inventors: Christian Charbon, Chezard-St-Martin (CH); Guido Plankert, Boppelsen (CH)

(73) Assignee: Nivarox-FAR S.A., Le Locle (CH)

( * ) Notice: Subject to any disclaimer, the term of this patent is extended or adjusted under 35 U.S.C. 154(b) by 128 days.

(21) Appl. No.: 14/896,818

(22) PCT Filed: Mar. 24, 2014

(86) PCT No.: PCT/EP2014/055858
§ 371 (c)(1),
(2) Date: Dec. 8, 2015

(87) PCT Pub. No.: WO2014/206582
PCT Pub. Date: Dec. 31, 2014

(65) Prior Publication Data

US 2016/0147195 A1 May 26, 2016

(30) Foreign Application Priority Data

Jun. 27, 2013 (CH) ..... 1182/13

(51) Int. Cl.
*G04B 1/14* (2006.01)
*C22C 38/38* (2006.01)
(Continued)

(52) U.S. Cl.
CPC ..... *G04B 1/145* (2013.01); *C21D 6/002* (2013.01); *C21D 6/005* (2013.01); *C22C 38/001* (2013.01);
(Continued)

(58) Field of Classification Search
CPC ..... G04B 1/14; G04B 1/145
See application file for complete search history.

(56) References Cited

U.S. PATENT DOCUMENTS 647,783 A 4/1900 Alleman
2,524,660 A 10/1950 Harder et al.
(Continued)

FOREIGN PATENT DOCUMENTS

BE 475783 A 9/1947
CH 279670 A 5/1952
(Continued)

OTHER PUBLICATIONS

Machine Translation of JP 2009084597.*
(Continued)

*Primary Examiner* — Edwin A. Leon
*Assistant Examiner* — Jason Collins
(74) *Attorney, Agent, or Firm* — Oblon, McClelland, Maier & Neustadt, L.L.P.

(57) ABSTRACT

A timepiece spring, as a mainspring, made of austenitic stainless steel including a base formed of iron and chromium, thickness of the spring being less than 0.20 mm, and the spring including, by mass: chromium: minimum value 15%, maximum value 25%; manganese: minimum value 5%, maximum value 25%; nitrogen: minimum value 0.40%, maximum value 0.75%; carbon: minimum value 0.10%, maximum value 1.00%; the total (C+N) carbon and nitrogen content between 0.40% and 1.50% by mass; the carbon-to nitrogen ratio (C/N) by mass between 0.125 and 0.550; impurities and additional metals with the exception of iron: minimum value 0%, maximum value 12.0%; iron: the complement to 100%.

33 Claims, 2 Drawing Sheets

(51) Int. Cl.

| | |
|---|---|
| ***C22C 38/00*** | (2006.01) |
| ***C21D 6/00*** | (2006.01) |
| ***C22C 38/44*** | (2006.01) |
| ***C22C 38/48*** | (2006.01) |
| ***C22C 38/58*** | (2006.01) |

(52) U.S. Cl.
CPC ..... *C22C 38/38* (2013.01); *C22C 38/44* (2013.01); *C22C 38/48* (2013.01); *C22C 38/58* (2013.01)

(56) References Cited

U.S. PATENT DOCUMENTS

| | | | | |
|---|---|---|---|---|
| 6,682,582 | B1 | 1/2004 | Speidel | |
| 2007/0133355 | A1* | 6/2007 | Hara | C22C 14/00 368/140 |
| 2011/0226391 | A1* | 9/2011 | Kim | C21D 1/18 148/542 |
| 2013/0127100 | A1* | 5/2013 | Ishida | C22C 38/58 267/166 |

FOREIGN PATENT DOCUMENTS

| | | | |
|---|---|---|---|
| CH | 330555 | A | 7/1958 |
| CH | 703 796 | B1 | 3/2012 |
| DE | 196 07 828 | A1 | 10/1996 |
| EP | 1 422 436 | A1 | 5/2004 |
| EP | 2 455 508 | A1 | 5/2012 |
| EP | 2 511 229 | A1 | 10/2012 |
| FR | 2 776 306 | A1 | 9/1999 |
| JP | 2-156047 | A | 6/1990 |
| JP | 2004-137600 | A | 5/2004 |
| JP | 2009084597 | A * | 4/2009 |
| JP | 2009-249658 | A | 10/2009 |
| KR | 2009-0092144 | A | 8/2009 |
| WO | 02/04836 | A2 | 1/2002 |
| WO | 2005/045532 | A2 | 5/2005 |

OTHER PUBLICATIONS

International Search Report dated Apr. 11, 2015 for PCT/EP2014/055858 Filed Mar. 24, 2014.

Vermot, et al. "Mecanque/Theorie; Energie de la montre mecanique," Traite de construction horlogere, 2011, pp. 24-29, XP002735465.

Aurele Maire, "Les barillets a rotation rapide," Jopurnal Suisse d'horlogerie, vol. 5/6, Jan. 1, 1968, pp. 213-219, XP002735466.

* cited by examiner

TIMEPIECE SPRING MADE OF AUSTENITIC STAINLESS STEEL

CROSS-REFERENCE TO RELATED APPLICATIONS

This is a National Phase Application in the United States of International Patent Application PCT/EP2014/055858 filed Mar. 24, 2014 which claims priority on Swiss Patent Application No 01182/13 of Jun. 27, 2013. The entire disclosure of the above patent applications are hereby incorporated herein by reference.

FIELD OF THE INVENTION

The present invention concerns a timepiece spring made of a stainless steel alloy including a base formed of iron and chromium, arranged in a face centred cubic structure and including manganese and nitrogen.

The invention also concerns a timepiece barrel including at least one spring of this type.

The invention also concerns a timepiece, particularly a watch, incorporating at least one such timepiece barrel and/or spring or this type.

The invention concerns the field of timepiece movements, and in particular mainsprings, striking springs or suchlike, and flat springs such as jumpers, shock absorbers, or suchlike.

BACKGROUND OF THE INVENTION

The resistance and longevity of timepiece springs, particularly mainsprings, is a long-standing problem. Timepiece spring manufacturers are always looking for materials providing an increased service life, essentially with improved fatigue resistance, and an increased power reserve for accumulator springs, mainsprings or striking springs in particular.

The use of high carbon steels very quickly allowed the desired characteristics of elasticity to be obtained, but their sensitivity to corrosion, combined with permanent use under forces closed to their fracture load, has frequently resulted in fracturing as soon as corrosion spots appear. Further, these steels tend to have permanent deformations, which impair the power reserve, since their proportional maximum lengthening is much lower than their limit of elasticity.

Numerous alloys have been tested, in the most varied compositions and with various treatments. Patent Nos. BE475783, CH279670 and U.S. Pat. No. 2,524,660 in the name of Elgin propose solutions employing a cobalt based alloy, a combination of chromium-molybdenum, and a combination of nickel, iron and manganese, with complex production methods which increase the cost of the product.

WO Patent No 2005/045532, in the name of Seiko, proposes a titanium based alloy, supplemented with vanadium group elements.

Some manufacturers have developed springs with surface layers different from the core material, such as in WO Patent No. 02/04836 in the name of Seiko, or CH Patent No 383886 in the name of Sandvik, or CH Patent No 330555 in the name of Fabrique Suisse de Ressorts d'Horlogerie, or EP Patent No 2511229 in the name of GFD-Diamaze, or EP Patent No 1422436 in the name of CSEM.

Amorphous alloys are also known from WO Patent No 2012/01941 in the name of Rolex, with a high proportion of boron, or EP Patent No 2133756 in the name of Rolex (metallic glass), or from DE Patent No 102011001783 in the name of Vacuumschmelze.

All these materials are extremely expensive, and no product that is really more effective than others for the application concerned has appeared on the market.

Numerous wholesale alloys could, purely theoretically, be suitable for manufacturing timepiece springs, but experimental testing of these alloys in real production conditions encounters numerous limitations, which explains the very limited development with respect to materials used in the watch industry for manufacturing springs, especially spiral springs.

Consequently, a large number of alloys, which would, on paper, be suitable, and which are perhaps suitable for macromechanics, electrical engineering, heavy machinery or suchlike, prove totally unworkable, as soon as attempts are made to convert them to the dimensions required for watchmaking.

There is known from CH Patent No 703796 in the name of Générale Ressorts, a nitrogen stainless steel including a base formed of iron and chromium, arranged in a face centred cubic austenitic structure. The alloy described in this document has a high concentration of nitrogen in solution (0.75 to 1%). During manufacture of the alloy, the concentration of nitrogen in the solution is difficult to control in a precise manner. A low increase in the amount of nitrogen in solution in the alloy may lead to a loss of ductility of the alloy, which defeats the required purpose of a material to be used as a spring.

Further, the nitrogen content has a strong influence on the precipitation kinetics of chromium nitrides, and when the nitrogen content is around 1%, the speed of tempering of the alloy which prevents the appearance of nitrides is high, which makes it difficult and expensive to industrialise the treatment processes for these alloys.

Further, the manufacture of springs from these alloys is very problematic. The conventional production plan consists in transforming a cast billet of alloy by forging, rolling, then processing by drawing or wire drawing a wire rod having a diameter of around 6 mm, which is then skinned and cleaned, prior to a series of cold rolling and wire drawing operations: in particular, the skinning and wire drawing operations are especially difficult, or impossible when it is sought to obtain springs of very small dimensions, particular spiral mainsprings for timepieces having a thickness of less than 0.200 mm, or balance springs for an escapement mechanism which may have a thickness of around 0.050 mm.

Indeed, these operations, which are necessarily carried out on the material, result in significant temperature elevations, of several tens or hundreds of degrees Celsius. Nitrogen steels, with a nitrogen content of around 1% or more, are very sensitive to such temperature elevations, since, from around 200"C., precipitations of nitrides or other embrittling compounds may be produced, which prohibits any watchmaking application for alloys whose theoretical composition ought to be satisfactory in order to achieve the required characteristics of elasticity. Embrittlement produces cracking in the drawn wire, making it unsuitable for secondary operations.

A reduction in the rolling and wire drawing speeds may reduce but not eliminate these temperature elevations, but these speeds are then so low that the cost of the material becomes prohibitive for industrial use. Indeed, to change from a diameter of 6 mm to a diameter of around 0.6 mm (i.e. in a cross-sectional area ratio of 100:1), between 30 and 50 successive wire drawing operations must be carried out (assuming that the cross-section is reduced by 9 to 15% each time), and more accurately around 50 operations in order to limit the number of heating points, in addition to the intermediate heat treatments which are also necessary.

Nitrogen steels are difficult to produce, difficult and expensive to implement, and consequently, they have met with little enthusiasm in the field of precision or ordinary mechanical engineering, the only known fields of application being orthodontics, prosthetics and electrotechnics (retaining rings for motors or alternators), hence essentially macroscopic or heavy machinery applications. The theoretical specific qualities attributed to nitrogen steels thus clash with practical realisation.

It is therefore not possible to use any type of nitrogen steel for manufacturing timepiece springs, because of these drawbacks, and it is important to make a very specific selection in order to produce a material, used as raw wire material, typically having a diameter of around 0.60 to 1.00 mm, which is then transformed by cold rolling to obtain a spring of substantially rectangular section.

The problem for the timepiece spring manufacturer is thus to determine an alloy having suitable nitrogen and carbon content to make it possible to produce, first a raw wire material having a diameter of several tens of millimeters, and then a profiled spring having a substantially rectangular section and a thickness of several hundredths of a millimeter.

Although an evident peculiarity of timepiece springs is their particular dimensions, another feature consists in their employment in very specific conditions of metal fatigue: these springs are permanently subjected to forces close to their fracture limit, which is known as oligocyclic fatigue. A material working at oligocyclic fatigue must be particularly perfect, to prevent any premature fracture after a reduced number of cycles.

An examination of alloys which, in theory, could be suitable for the manufacture of timepiece springs will logically concern austenitic alloys with a face centred cubic structure.

U.S. Pat. No. 6,682,582B1 in the name of Speidel BASF describes various alloys, with a high proportion of chromium (16 to 22%), between 0.08% and 0.30% by mass of carbon, and between 0.30% and 0.70% by mass of nitrogen, and less than 9% manganese and less than 2% molybdenum.

KR Patent No 2009 0092144 in the name of Korea Mach. & Materials INST discloses a manganese-chromium-nickel-molybdenum alloy with the total content of carbon and nitrogen comprised between 0.60% and 0.90% by mass, with notably, in some alloys of the family having a carbon content of less than 0.45% by mass and a nitrogen content of less than 0.45% by mass.

JP Patent No H02156047 in the name of Nippon Steel Corp discloses an alloy with 5 to 25% manganese, 15 to 22% chromium, 0.10% to 0.30% carbon and 0.3% to 0.6% nitrogen.

Choosing an alloy that can actually be transformed to manufacture a timepiece spring is difficult, faced with the wealth of literature. A large number of documents describe alloys, which, only in theory, could be suitable, since they are austenitic alloys which seem to have the required peculiarities, such as as JP Patent Application No 2004137600A in the name of Nano Gijutsu Kenkyusho, JP Patent Application No 2009249658A in the name of Daido Steel Co Ltd., FR Patent Application No 2776306A1 in the name of Ugine Savoie SA, or DE Patent Application No 19607828A1 in the name of VSG EN & Schmiedetechnik GmbH.

It is clear that, although all the alloys described in these documents could in theory be suitable, very few satisfy the shaping requirements of those skilled in the art, who must then undertake extensive testing in order to make a selection, and test each selected alloy in real production conditions, which is not within the grasp of the mere reader of these documents.

More specifically, a mainspring, the drive element of a mechanical watch, is manufactured from a metal strip, and then wound around an arbour and housed inside a barrel drum. The document by Aurèle MAIRE, in the *Journal Suisse d'horlogerie*, vol. 5/6, 1 Jan. 1968, pages 213-214 XP001441388, sets out a theory of fast-rotating barrels, describing the free, treble clef shape of a spiral spring, and the optimised geometry for maximum available energy.

The conventional manufacture of a spiral spring, particularly a mainspring, from a raw wire material having a diameter of several tens of mm (which is already a product transformed during an extremely long and complex process as described above) is achieved in several steps:

- rolling a metal wire to obtain a strip,
- cutting the strip to a defined length, optionally also cutting out an aperture at one end thereof,
- forming an eye at the end of the strip containing the aperture to enable the strip to be fixed to an arbour (either through an aperture made in the strip if the arbour contains a hook, or by the friction of the strip on the arbour). This step is carried out in two parts:
  - forming the first eye which is a circle having a smaller diameter than the arbour to ensure that the hook is hooked in the aperture or the strip is held by friction, depending on the case;
  - forming a second eye which, in practice, is a spiral of increasing radius over around 0.75 turns, so as to ensure the eye is centred in the drum when the spring is let down.
- roller levelling the remainder of the strip in the opposite direction to the eye;
- fixing the flange;
- placing inside the drum.

The peculiarity of the mainspring is that the material works at its maximum stress throughout the curvilinear abscissa due to the deformation imparted during the first winding. If the spring is removed from the drum, a treble clef shape of equilibrium results from the first winding.

For the watch designer seeking to produce springs with good resistance and satisfactory longevity, which can be produced in a reliable and especially repetitive manner, the difficulty lies in choosing or developing an alloy which enables the required performance to be obtained and can produce spiral springs including at least one area of thickness of less than 0.200 m, and/or including at least one area having a radius of curvature of less than 2.15 mm and notably less than 0.75 mm, or even 0.60 mm. The watch designer therefore cannot simply choose an alloy from a catalogue based on its theoretical physical characteristics, but must test a specific range of secondary operations, on the one hand for the wire serving as raw material, and on the other hand, for the finished spring, and set parameters for the composition and treatment of the alloy, which make it possible to produce wire blanks and springs of this type.

SUMMARY OF THE INVENTION

It is an object of the invention to produce a spring for a timepiece or piece of jewelry, notably a spiral spring such as a mainspring, or striking spring or suchlike, or a flat spring such as a jumper, shock absorber or suchlike, having improved ductility, which is less expensive, and easier to produce on industrial scale, in comparison to ordinary alloys used for the manufacture of springs of this type.

Indeed, known high nitrogen alloys (more than 1% by mass) provide high mechanical properties, but are more difficult to transform, since an alloy with a high nitrogen content is brittle, and the precipitation kinetics of chromium nitride are very fast, which makes this type of alloy difficult to implement.

The invention therefore concerns a spring for a timepiece or piece of jewelry made of a stainless steel alloy including a base formed of iron and chromium, arranged in a face centred cubic structure, and of the super-austenitic type including manganese and nitrogen, characterized in that, at least in the area of smallest thickness thereof, said spring has a thickness of less than 0.20 mm, and further characterized in that the composition by mass of said alloy is:

chromium: minimum value 15%, maximum value 25%;
manganese: minimum value 5%, maximum value 25%;
nitrogen: minimum value 0.10%, maximum value 0.90%;
carbon: minimum value 0.10%, maximum value 1.00%;
with the total (C+N) carbon and nitrogen content comprised between 0.40% and 1.50% by mass;
with the carbon-to nitrogen ratio (C/N) comprised between 0.125 and 0.550;
impurities and additional metals with the exception of iron: minimum value 0%, maximum value 12.0%;
iron: the complement to 100%.

The invention also concerns a timepiece barrel including at least one spring of this type.

The invention also concerns a timepiece, particularly a watch, incorporating at least one such timepiece barrel and/or spring or this type.

Due to the low nitrogen content, high mechanical properties can be obtained by adding carbon, while also improving industrial implementation of the alloy. The low nitrogen content improves, in particular, the ductility of the alloy. Further, the presence of additional carbon may allow the formation of carbides which improve the mechanical properties of the alloy.

When this alloy is used for the manufacture of a barrel used as the energy source for a mechanical timepiece movement, its improved ductility makes it possible to reduce the diameter of the eye and therefore to increase, for a given barrel drum diameter, the power reserve of the movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
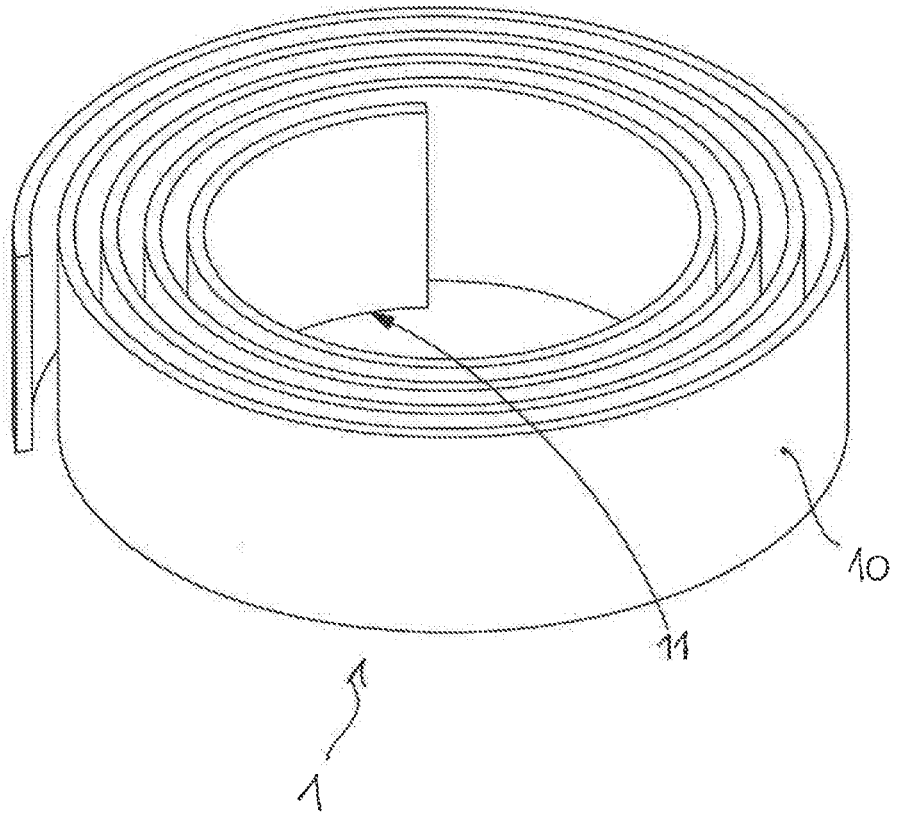
FIG. 1 shows a schematic, perspective view of a mainspring according to the invention, with the inner areas of the eye and the outer areas for securing a flange not shown in detail.

The invention concerns the field of timepiece movements, and in particular springs for storing energy, return or shock absorber springs: spiral springs such as a mainspring, or striking spring, or suchlike or a flat spring such as a jumper, shock absorber or suchlike.

It is an object of the invention to address the problem of producing timepiece springs having extreme longevity, small dimensions and notably spiral springs having a thickness of less than 0.200 mm.

A very long campaign of tests is required to test theoretically suitable alloys and to set the parameter(s) permitting feasibility with the required performance and dimensions.

More specifically, the problem is amplified with regard to the production of a spiral spring 1 having an inner coil 11 adapted, in the case of a barrel, to a core or an arbour 50 of very small diameter, less than 4.3 mm and notably less than 1.5 mm, or even less than 1.2 mm in so called barrels with "reduced core diameter", or in the case of a balance spring for an escapement mechanism with a collet also having a very small diameter, notably less than 1.5 mm. Metallurgical tests are particularly focussed on maximum lengthening values.

The experimental campaign demonstrates that suitability for manufacturing a spiral spring is directly connected to the C/N ratio, between the mass of carbon and of nitrogen in the alloy, which must be comprised within a specific range, and to the absolute and relative maximum mass of carbon and nitrogen. This manufacture conventionally includes a blank production process including transformation of a cast billet of alloy by forging, rolling and possibly by drawing or wire drawing to obtain a wire rod having a diameter of around 6 mm, which is then skinned and cleaned, prior to a series of other wire drawing operations separated by recrystallisation heat treatments. A finishing process follows, which may include at least one more wire drawing, and at least one cold rolling, then specific finishing operations for setting the geometry of the spiral, in a free profile known as a treble clef.

The inherent difficulty in the manufacture of a spiral timepiece spring 1 is the creation of at least one area having a very low radius of curvature, notably a radius of curvature of less than 2.15 mm.

A particular case is that of a barrel having a reduced core diameter, i.e. having a K factor of less than 9: during normal manufacture of a mainspring, based on experience, the K factor (the ratio of the barrel axis to the thickness of the strip of the spring) is between 9 and 16 to ensure that the product is not fragile and is able to be produced. Horological theory recommends a K factor of between 10 and 16, with the value of 11 being most commonly used. Any reduction in the K factor makes it possible to substantially increase the number of turns of the mainspring, for an equivalent external volume, and thus to increase the power reserve of the watch. This reduction is connected to minimisation of the core diameter, well below the value of 2.15 mm, and particularly below the value of 1.5 mm, which means that the alloy chosen and the treatment thereof must allow the creation of radii of curvature as low as 2.15 mm or less, without breaking or long term weakening of the spring. The problem is similar for a balance spring for an escapement mechanism, wherein the inner coil rests on a collet having dimensions comparable to those of the core of a mainspring.

The invention makes it possible to define a steel alloy suitable for the manufacture of timepiece springs, particularly for a mainspring or balance spring for an escapement mechanism, having improved ductility and which is easier to produce industrially in comparison to prior art alloys.

The invention therefore concerns a spring 1 for a timepiece or piece of jewelry made of a stainless steel alloy including a base formed of iron and chromium, arranged in an austenitic face centred cubic structure, and including manganese and nitrogen, According to the invention, at least in the area of smallest thickness thereof, spring 1 has a thickness of less than 0.20 mm, According to the invention, the mass composition of the alloy of spring 1 is:

- chromium: minimum value 15%, maximum value 25%;
- manganese: minimum value 5%, maximum value 25%;
- nitrogen: minimum value 0.10%, maximum value 0.90%;
- carbon: minimum value 0.10%, maximum value 1.00%;
- with the total (C+N) carbon and nitrogen content comprised between 0.40% and 1.50% by mass;
- with the carbon-to nitrogen ratio (C/N) comprised between 0.125 and 0.550;
- impurities and additional metals with the exception of iron: minimum value 0%, maximum value 12.0%;
- iron: the complement to 100%.

More specifically, the total carbon and nitrogen content is comprised between 0.4% and 1.5%, and the carbon-to-nitrogen ratio is comprised between 0.125 and 0.5.

In a particular embodiment, the nitrogen content is comprised between 0.40% and 0.75% by mass.

In a particular embodiment, the nitrogen content is comprised between 0.45% and 0.55% by mass.

In a particular embodiment, the carbon content is comprised between 0.15% and 0.30% by mass.

In a particular embodiment, the carbon content is comprised between 0.15% and 0.25% by mass.

In a particular embodiment, the total (C+N) carbon and nitrogen content is comprised between 0.60% and 1.00% by mass.

In a particular embodiment, the total (C+N) carbon and nitrogen content is comprised between 0.60% and 0.80% by mass.

In a particular embodiment, the carbon-to nitrogen ratio (C/N) is comprised between 0.250 and 0.550.

In a more specific embodiment, the carbon-to nitrogen ratio (C/N) is comprised between 0.270 and 0.550.

More specifically, the total carbon and nitrogen content is comprised between 0.4% and 1.5%, and the carbon-to-nitrogen ratio is comprised between 0.125 and 0.5.

The choice of a domain wherein, at the same time:

- the total (C+N) carbon and nitrogen content is comprised between 0.60% and 0.80% by mass; and
- the carbon-to nitrogen ratio (C/N) is comprised between 0.270 and 0.550;

is particularly favourable as regards stacking fault energy.

According to an advantageous variant, the total carbon and nitrogen content of the alloy is comprised between 0.6% and 1% by mass and the carbon-to-nitrogen ratio of the alloy is comprised between 0.35 and 0.5.

According to a preferred variant, the total carbon and nitrogen content of the alloy is comprised between 0.75% and 1% by mass and the carbon-to-nitrogen ratio of the alloy is comprised between 0.4 and 0.5.

In a particular embodiment, the chromium content, which is present to ensure corrosion resistance (which is historically a major problem for the resistance of timepiece springs, particular mainsprings), is comprised between 16.0% and 20.0% by mass.

In a particular embodiment, the content of chromium is comprised between 16.0% and 17.0% by mass.

According to an advantageous embodiment, the chromium content of the alloy is comprised between 16% and 20% by mass and the carbon content is comprised between 0.15% and 0.3% by mass.

According to another advantageous embodiment, the manganese content of the alloy is comprised between 10% and 16% by mass and preferably between 11% and 13%, and the niobium content is less than 0.25% by mass.

According to a specific composition, at least one of said additional metals is a carburising element selected from among a group including molybdenum, tungsten, vanadium, niobium, zirconium and titanium, replacing an equivalent mass of iron in the alloy, with a content comprised between 0.5% and 10.0% by mass. The impurities or other additional metals, with the exception of iron, are then limited to 3% and particularly to 2%.

In a specific embodiment, this at least one carburising element is molybdenum, with a content comprised between 2.5% and 4.2% by mass Molybdenum improves resistance to corrosion and pitting; it allows for precipitation of molybdenum carbides. In a particular embodiment, the molybdenum content is comprised between 2.6% and 2.8% by mass.

According to yet another embodiment the alloy also includes, to a maximum limit of 0.5% by mass, at least one other carburising element other than molybdenum, taken from among a group including tungsten, vanadium, niobium, zirconium and titanium, replacing an equivalent mass of iron in the alloy, and the nickel content of the alloy is preferably less than 0.5% by mass.

In a specific embodiment, the total content of impurities and additional metals, with the exception of iron, is comprised between 0 and 6.0% by mass.

In a specific embodiment, the total content of impurities and additional metals, with the exception of iron, is comprised between 0 and 3.0% by mass.

In a specific embodiment, one of the additional metals is nickel. Like manganese, nickel promotes formation of an austenitic phase and improves solubility. For an application to a spring contained within a movement, having no cutaneous contact with the user, it is possible to include several percent nickel in the alloy with no negative consequences for the user. In a particular embodiment, the nickel content is comprised between 0 and 0.10% by mass.

In a particular embodiment, one of the additional metals is niobium, with a content comprised between 0 and 0.25% by mass.

The austenitic structure of this type of alloy is, in fact, necessary for a spring, owing to the good cold deformability that it affords. Another advantage of this structure, which is far from negligible in a timepiece movement, is connected to the non-magnetic nature of austenite, unlike ferrite or martensite.

Here too, the choice of a relatively low C/N ratio, particularly less than 0.550 is sufficient to take advantage of the presence of carbon, and exhibits, in comparison to a higher C/N ratio, for the same C+N total, a greater ability of the alloy to take an austenitic structure, as seen in the equilibrium diagrams in the literature. Likewise, a nitrogen content that is not too low keeps away from the ferritic domain.

The invention allows for a more economical production of timepiece springs than that of known prior art springs, which have a high nitrogen content making them difficult and expensive to transform. Indeed, in such case, the processing methods must be carried out at high pressure (several atmospheres) and/or using additives.

This is why it is advantageous to replace one part of the nitrogen with carbon. It is known that the brittle-ductile transition temperature TT of a stainless alloy of the type being considered approximately follows a rule whereby the value of TT in Kelvin is proportional to the total of a first term equal to 300 times the nitrogen content and a second term equal to 100 times the carbon content.

Any replacement of nitrogen with carbon thus has a direct effect, with a decrease in the brittle-ductile transition temperature. Indeed, the use of a low nitrogen content, a the lowest nitrogen content level of known prior art alloys, makes it possible to maintain high mechanical properties by adding carbon, through the formation of carbides, while also improving the industrial implementation of the alloy. The low nitrogen content improves, in particular, the ductility of the alloy. The reduction in nitrogen content is also favourable as regards nitride precipitation When an alloy according to the invention is used for manufacturing a mainspring used as the energy source in a mechanical timepiece movement, advantage is taken of its improved ductility, which allows the diameter of the eye to be decreased and thereby the power reserve of the movement to be increased, for a given barrel drum diameter.

As regards industrial production, the development of an alloy with both carbon and nitrogen, in these quantities and proportions, may carried out at atmospheric pressure, which constitutes a clear economic advantage. These particular carbon and nitrogen contents, selected for the invention, represent a good compromise, wherein the alloy includes sufficient nitrogen to stabilise the austenitic structure, and these particular compositions provide the most stable alloys.

By selecting particular embodiments of the alloy, a particular position is obtained below, particularly suitable for timepiece springs and more particularly for mainsprings, with acceptable development costs, implementation having no particular complications, very good mechanical characteristics, good corrosion resistance, low plastic deformation and high longevity. This particular composition is:

- chromium: minimum value 16.0%, maximum value 17.%;
- manganese: minimum value 9.%, maximum value 12.5%;
- nitrogen: minimum value 0.45%, maximum value 0.55%;
- carbon: minimum value 0.15%, maximum value 0.25%;
- with the total (C+N) carbon and nitrogen content comprised between 0.60% and 0.80% by mass;
- with the carbon-to nitrogen ratio (C/N) comprised between 0.7 and 0.55;
- molybdenum: minimum value 2.6%, maximum value 2.8%;
- impurities and additional metals with the exception of iron: minimum value 0%, maximum value 3.0%;
- iron: the complement to 100%.

The spring 1 thereby produced has an austenitic structure with high mechanical resistance, and exhibits high fatigue resistance, high corrosion resistance and is non-magnetic.

In an application to a spiral timepiece spring, for a barrel or escapement mechanism, spring 1 includes at least one area having a radius of curvature of less than 2.15 mm.

In an advantageous application, spring 1 according to the invention is a spiral spring and particularly a mainspring or a balance spring for an escapement mechanism.

More specifically, this spring 1 includes an inner coil 11 which has a radius of curvature of less than 2.15 mm, notably less than 0.75 mm.

More specifically, in its area of smallest thickness, and particularly on inner coil 11, this spring 1 has a thickness of less than 0.20 mm, notably less than 0.06 mm.

FIG. 1 shows the particular case where spring 1 is a spiral mainspring 10.

Figure 2:
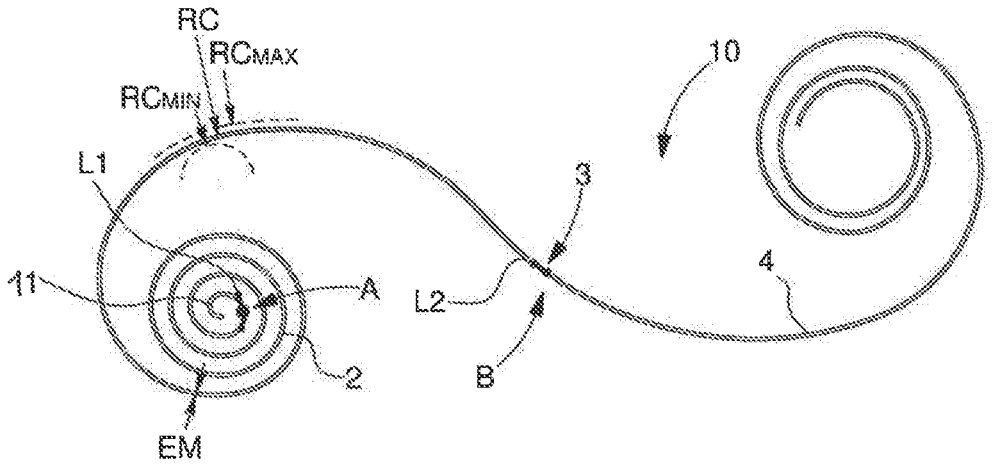
FIG. 2 shows a mainspring according to the invention, in its free treble clef form, with a substantially linear portion in an area of reversed concavity.
Figure 3:
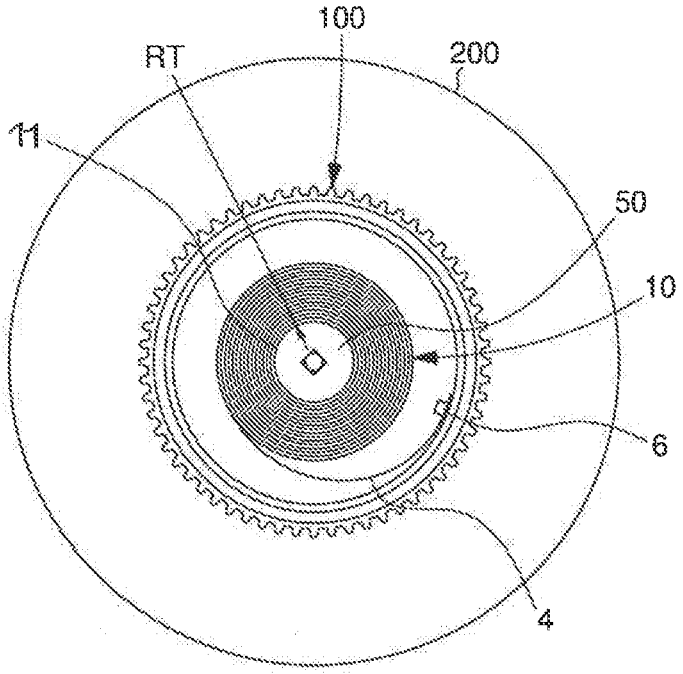
FIG. 3 shows a schematic view of a timepiece including a barrel equipped with a spring according to the invention.

FIG. 2 illustrates a timepiece mainspring intended to be wound in a spiral around an arbour 50, and including a strip with a first inner coil 11 forming a first eye, having a first length L1 between its inner end and a point A seen in FIG. 2, and which is adapted to an arbour 50 of given theoretical radius RT.

In the following description, the following terms will be used:

- first coil 1 or first eye to designate the innermost coil of the mainspring, which is intended to encircle the barrel arbour in one turn, and
- second coil 2 or second eye, the part of the spring which is immediately downstream of this first coil, having the same direction of concavity as first coil 1 in an initial, post-manufacturing state, and prior to any assembly on an arbour and prior to any winding, in the free and flat state, of the mainspring according to the invention.

The side of inner coil 11 of the spring where it is fixed to the barrel arbour will be referred to as the "upstream side" and the side of outer coil 4 hooked to the barrel drum will be referred to as the "downstream side".

According to the invention, in an initial, post-manufacturing state, and prior to any assembly on arbour 50 and prior to any winding, in the free and flat state, this spring 10 includes, from the interior outwards, after first inner coil 11, a second coil 2 having a second length L2 (between point A and a bending point B seen in FIG. 2), and having the same direction of concavity as first inner coil 11.

A winding 4 having the opposite direction of concavity to that of inner coil 11 follows said second coil 2 through a bending area 3.

The shape of spring 10 according to the invention includes, at any point outside this bending area 3, a local radius of curvature RC which is comprised between a minimum local radius of curvature RCMIN and a maximum local radius of curvature RMAX.

Local radius of curvature RC is higher than the minimum local radius of curvature RCMIN to ensure that the strip of spring 10 is subjected to its maximum stress at every point on its curvilinear abscissa from the first winding thereof.

Local radius of curvature RC is lower than the maximum local radius of curvature RCMAX to ensure that spring 10 does not break when placed inside the drum.

In the preferred case with a K factor of less than 9, the second length L2 of said second coil 2 is calculated to obtain a predetermined ratio between the theoretical radius RT on the one hand, and the mean thickness EM of spring 10 on first inner coil 11, on the other hand, this predetermined ratio being lower than 9.

In order to be able to manufacture a mainspring with a reduced core diameter (K factor much lower than 9), a first standard eye must be made, followed by a second eye of more than 0.75 turns so as not to exceed the fracture limit of the material when it is placed inside the drum.

In particular, in a specific application to a spring 10 made of an alloy according to the invention, the second developed length L2 of second coil 2 corresponds to a spiral having at least one turn of spring 10, so as to reduce the stress of spring 10 when it is first wound and implemented in a so-called service state, and so as to reduce the local difference in curvature as far as possible at any point between said initial state and said service state.

In a variant, it is possible to work with other parameters, in particular but not limited to:

thinning the strip close to the eye;

applying a particular heat treatment close to the eye to improve the ductility of the material;

forming the alloy forming the spring;

The invention goes beyond the usual domain of use, for a spring made of a given material.

The invention makes it possible to implement a K factor even lower than known factors, for a given material.

In the particular application of the invention to a barrel having a reduced core, this predetermined K factor is less than 9 and preferably close to 5 or 6.

A very low K factor is very favourable since it makes it possible to increase the power reserve of the associated barrel. Indeed, the volume saved translates into an increase in the number of development turns of the mainspring.

Specifically, the second developed length L2 of second coil 2 corresponds to at least two turns of spring 10 so as to reduce the stress of spring 10 when it is first wound for use and placed in a service state, and so as to reduce as far as possible the local difference in curvature at any point between the initial state and the service state.

The invention also concerns a timepiece barrel 100 including an arbour 50 having a given theoretical radius RT and at least one spring 10 of this type.

The invention also concerns a timepiece 200 including at least one barrel 100 and/or at least one spring 1 or a spiral spring 1 according to the invention.

The invention claimed is:

1. A spring for a timepiece or piece of jewelry comprising a stainless steel alloy comprising:

a base comprising iron and chromium, arranged in an austenitic face centered cubic structure and comprising manganese and nitrogen, wherein, at least in an area of smallest thickness thereof, the spring has a thickness of less than 0.20 mm;

and further wherein composition by mass of the alloy is:

chromium: minimum value 15%, maximum value 25%;

manganese: minimum value 5%, maximum value 25%;

nitrogen: minimum value 0.40%, maximum value 0.75%;

carbon: minimum value 0.10%, maximum value 1.00%;

with the total (C+N) carbon and nitrogen content between 0.50% and 1.50% by mass;

with the carbon-to-nitrogen ratio (C/N) by mass between 0.133 and 0.550;

impurities and additional metals with the exception of iron: minimum value 0%, maximum value 12.0%;

iron: the complement to 100%.

2. The spring according to claim 1, wherein the nitrogen content is between 0.45% and 0.55% by mass.

3. The spring according to claim 1, wherein the carbon content is between 0.15% and 0.30% by mass.

4. The spring according to claim 3, wherein the carbon content is between 0.15% and 0.25% by mass.

5. The spring according to claim 4, wherein the total (C+N) carbon and nitrogen content is between 0.60% and 1.00% by mass.

6. The spring according to claim 5, wherein the total (C+N) carbon and nitrogen content is between 0.60% and 0.80% by mass.

7. The spring according to claim 1, wherein the carbon-to-nitrogen ratio (C/N) by mass is between 0.250 and 0.550.

8. The spring according to claim 7, wherein the carbon-to-nitrogen ratio (C/N) by mass is between 0.270 and 0.550.

9. The spring according to claim 1, wherein the manganese content is between 9.5% and 12.5% by mass.

10. The spring according to claim 1, wherein the chromium content is between 16.0% and 20.0% by mass.

11. The spring according to claim 10, wherein the chromium content is between 16.0% and 17.0% by mass.

12. The spring according to claim 10, wherein at least one of the additional metals is a carburigen element selected from the group consisting of molybdenum, tungsten, vanadium, niobium, zirconium and titanium, with a content between 0.5% and 10.0% by mass.

13. The spring according to claim 12, wherein one of the additional metals is molybdenum, with a content between 2.5% and 4.2% by mass.

14. The spring according to claim 13, wherein the molybdenum content is between 2.6% and 2.8% by mass.

15. The spring according to claim 13, wherein the alloy further comprises, up to a limit of 0.5% by mass of the total alloy, at least one carburigen element other than molybdenum, selected from the group consisting of tungsten, vanadium, niobium, zirconium and titanium.

16. The spring according to claim 1, wherein the total content of the impurities and the additional metals, with the exception of iron, is between 0 and 6.0% by mass.

17. The spring according to claim 16, wherein the total content of the impurities and the additional metals, with the exception of iron, is between 0 and 3.0% by mass.

18. The spring according to claim 1, wherein one of the additional metals is nickel.

19. The spring according to claim 18, wherein the nickel content is between 0 and 0.10% by mass.

20. The spring according to claim 1, wherein one of the additional metals is niobium, with a content of between 0 and 2.5% by mass.

21. The spring according to claim 1, wherein the mass percent composition thereof is:

chromium: minimum value 16.0%, maximum value 17.0%;

manganese: minimum value 9.5%, maximum value 12.5%;

nitrogen: minimum value 0.45%, maximum value 0.55%;

carbon: minimum value 0.15%, maximum value 0.25%;

with the total (C+N) carbon and nitrogen content between 0.60% and 0.80% by mass;

with the carbon-to nitrogen ratio (C/N) by mass between 0.27 and 0.55;

molybdenum: minimum value 2.6%, maximum value 2.8%;

impurities and additional metals with the exception of iron: minimum value 0%, maximum value 3.0%;

iron: the complement to 100%.

22. The spring according to claim 1, wherein the spring includes at least one area having a radius of curvature of less than 2.15 mm.

23. The spring according to claim 22, wherein the spring includes at least one area having a radius of curvature of less than 0.75 mm.

24. The spring according to claim 1, wherein the spring is a spiral spring which includes an inner coil having a radius of curvature of less than 2.15 mm.

25. The spring according to claim 1, wherein the spring is a spiral spring which has, at least in the area of smallest thickness on the inner coil thereof, a thickness of less than 0.2 mm.

26. The spring according to claim 1, wherein the spring is a mainspring.

27. The spring according to claim 26, configured to be wound in a spiral around an arbor and including a strip with a first inner coil forming a first eye, having a first length, and adapted to the arbor having a given theoretical radius, wherein, in an initial, post-manufacturing state, and prior to any assembly on the arbor and prior to any winding, in a free and flat state, the spring includes, from an interior outwards, following the first inner coil, a second coil having a second length and same direction of concavity as the first inner coil, followed, through a bending area, by a winding whose direction of concavity is opposite to that of the inner coil, and wherein a shape of the spring includes at every point outside the bending area a local radius of curvature which is between a minimum local radius of curvature and a maximum local radius of curvature, the local radius of curvature being higher than the minimum local radius of curvature to subject the strip of the spring to maximum stress at every point on the curvilinear abscissa from the first winding thereof, and the local radius of curvature being lower than the maximum radius of curvature so that the spring does not break when placed inside a drum.

28. The spring according to claim 27, wherein the second coil having a second length corresponds to a spiral of at least one turn of the spring, to reduce stress applied to the spring when the spring is first wound for use and placed in a service state, and to reduce local difference in curvature as far as possible at any point between the initial state and the service state.

29. The spring according to claim 27, wherein the local radius of curvature is higher than the minimum local radius of curvature so that the strip of the spring is subjected to maximum stress at every point on the curvilinear abscissa thereof from the first winding thereof.

30. The spring according to claim 27, wherein the local radius of curvature is lower than the maximum local radius of curvature so that the spring does not break when placed inside the drum.

31. A timepiece barrel comprising an arbor of given theoretical radius, and at least one spring according to claim 27.

32. A timepiece, or a watch, comprising at least one barrel according to claim 31.

33. A timepiece, or a watch, comprising a spring according to claim 1.

* * * * *